US011198025B2

(12) United States Patent
Barbeau et al.

(10) Patent No.: US 11,198,025 B2
(45) Date of Patent: Dec. 14, 2021

(54) HOOK AND DEE FOR FIREFIGHTER PROTECTIVE COATS

(71) Applicant: INNOTEX INC., Richmond (CA)

(72) Inventors: Claude Barbeau, St-Bruno (CA); Eric St-Arneault, Carignan (CA)

(73) Assignee: INNOTEX INC.

( * ) Notice: Subject to any disclaimer, the term of this patent is extended or adjusted under 35 U.S.C. 154(b) by 488 days.

(21) Appl. No.: 15/941,414

(22) Filed: Mar. 30, 2018

(65) Prior Publication Data

US 2018/0280737 A1 Oct. 4, 2018

Related U.S. Application Data

(60) Provisional application No. 62/479,677, filed on Mar. 31, 2017.

(51) Int. Cl.
*A62B 17/00* (2006.01)
*A44B 13/00* (2006.01)
*A44B 13/02* (2006.01)

(52) U.S. Cl.
CPC ..... *A62B 17/001* (2013.01); *A62B 17/003* (2013.01); *A41D 2300/326* (2013.01); *A44B 13/0052* (2013.01); *A44B 13/02* (2013.01)

(58) Field of Classification Search
CPC ..... A62B 17/001; A62B 17/003; A41D 2300/326; A41D 31/08; A41D 2300/30; A41D 3/00; A41D 3/02; A41D 3/04; A41D 1/02; A41D 2300/322; A41D 2300/324; A44B 13/0052; A44B 13/02; A44B 13/00; A44B 13/0029; A44B 13/0017; Y10T 24/3471; Y10T 24/4523
USPC ... 2/81, 85, 93, 96, 457, 458, 86, 87, 94, 97
See application file for complete search history.

(56) References Cited

U.S. PATENT DOCUMENTS 1,067,234 A * 7/1913 Atchinson ..... A44B 13/0011 24/359
3,751,770 A * 8/1973 Italiano ..... A44B 13/0052 24/697.1
5,189,737 A * 3/1993 Ribicic ..... A41D 13/00 2/81
5,572,741 A * 11/1996 Bowman ..... A62B 17/003 2/244

(Continued)

FOREIGN PATENT DOCUMENTS

FR 400563 A * 7/1909 ..... A44B 13/02

*Primary Examiner* — F Griffin Hall
(74) *Attorney, Agent, or Firm* — Dilworth IP, LLC

(57) ABSTRACT

There is provided a firefighter protective coat including an outer shell and a plurality of hook-and-dee pairs. The outer shell has left and right front panels and a closable front opening. The left and right front panels have a border area extending along the front opening and includes a closure flap foldable over the border area. Each hook-and-dee pair includes a hook and a dee. The hook includes a hooking piece extending across a width of the border area and an asymmetric base fastened to coat panel. The asymmetric base includes upper and lower wings projecting strictly on top and bottom sides of the hooking piece. The dee is affixed to another coat panel and is in alignment with the corresponding hook. The dee includes a ring engageable with the hooking piece and a longitudinal base fastened to the corresponding coat panel and extending parallelly to the front opening.

22 Claims, 12 Drawing Sheets

(56) References Cited

U.S. PATENT DOCUMENTS

| | | | | |
|---|---|---|---|---|
| 5,806,097 | A * | 9/1998 | Grilliot | A62B 17/006 2/457 |
| 2007/0017008 | A1* | 1/2007 | Snedeker | A41D 31/305 2/456 |
| 2017/0224035 | A1* | 8/2017 | Callesen | A41D 27/04 |

* cited by examiner

HOOK AND DEE FOR FIREFIGHTER PROTECTIVE COATS

TECHNICAL FIELD

The technical field generally relates to protective garments for firefighters and more particularly concerns a closure assembly for a firefighter protective coat.

BACKGROUND

Firefighter garments, such as coats, have designs which are required to be compliant with the National Fire Protection Association Standard on Protective Ensembles for Structural Fire Fighting and Proximity Fire Fighting.

Turnout coats are typically worn by firefighters or other first respondents. Such coats typically have fasteners in a closure area for allowing the firefighters to don and close their coat.

The fasteners are typically covered by flaps (i.e., layer(s) of material) for covering the closure area and protecting the firefighter, hence offering a 360-degree protection against heat and flames.

Existing fasteners and flaps typically have dimensions which may limit the movement of the firefighter, and may not be comfortable.

There remains a need in the art for compact closure assembly for firefighter garments, and more specifically firefighter protective coats that improve comfort of the wearer.

SUMMARY

In accordance with one aspect, there is provided a firefighter protective coat including an outer shell and a plurality of hook-and-dee pairs. The outer shell has left and right front panels defining a closable front opening therebetween. The left and right front panels each have a border area extending along the front opening and further includes a closure flap foldable over the border area. Each hook-and-dee pair includes a hook and a dee. The hook is affixed to one of the left and right front panels within the corresponding border area. The hook includes a hooking piece extending across a width of the border area and an asymmetric base fastened to the corresponding coat panel. The asymmetric base includes upper and lower wings projecting strictly on top and bottom sides of the hooking piece. The dee is affixed to an opposite one of the left and right front panels within the corresponding border area and in alignment with the corresponding hook of said pair. The dee includes a ring engageable with the hooking piece of the corresponding hook and a longitudinal base fastened to the corresponding coat panel and extending parallelly to the front opening.

In some embodiments, the firefighter protective coat includes a zipper for closing the closable front opening.

In some embodiments, the firefighter protective coat includes fasteners. The asymmetric base includes a plurality of hook attachment holes, each one of the plurality of hook attachment holes being traversed by one corresponding fastener for affixing the hook to said one of the left and right front panels, and the longitudinal base includes a plurality of dee attachment holes, each one of the plurality of dee attachment holes being traversed by another one corresponding fastener for affixing the dee to said opposite one of the left and right front panels.

In some embodiments, the upper wing includes two of the plurality of hook attachment holes and the lower wing includes one of the plurality of hook attachment holes.

In some embodiments, the longitudinal base includes two of the plurality of dee attachment holes, the two of the plurality of dee attachment holes extending parallelly to the front opening.

In some embodiments, the fasteners are capped rivets.

In some embodiments, each one of the hooks forming the plurality of hook-and-dee pairs is affixed to the right front panel and each one of the dees forming the plurality of hook-and-dee pairs is affixed to the left front panel.

In some embodiments, the upper and lower wings have an extend defining a footprint area, the footprint area being fully confined within said corresponding closure border area.

In some embodiments, the hooking piece has a length equal to or smaller than about 5.5 cm.

In some embodiments, the dee has a length equal to or smaller than about 3.9 cm.

In some embodiments, the closure border area has a width equal to or smaller than about 7.6 cm.

In some embodiments, the left front panel closure flap is an internal flap having two opposed internal flap longitudinal edges, one of the two opposed internal flap longitudinal edges being fixedly attached to the left front panel and another one of the two opposed internal flap longitudinal edges being free and transversally foldable onto the plurality of hook-and-dee pairs. The right front panel flap is an external flap having two opposed external flap longitudinal edges, one of the two opposed external flap longitudinal edges being fixedly attached to the right front panel, and another one of the two opposed external flap longitudinal edges being free and transversally foldable onto the internal flap.

In some embodiments, the internal flap has an outer surface including a strip of hook fasteners, and the external flap has an inner surface including a strip of loop fasteners, engageable with the strip of hook fasteners, the strip of loop fasteners being engaged with the strip of hook fastener when the external flap is folded onto the internal flap.

In some embodiments, the firefighter protective coat includes a plurality of snap fasteners, each one of the plurality of snap fasteners including a pair of interlocking discs. The internal flap has an outer surface including one of the pair of interlocking discs. The external flap has an inner surface including another one of the pair of interlocking discs, the pair of interlocking discs being interlocked with one another when the external flap is folded onto the internal flap.

In some embodiments, the flaps are made of a fire-retardant material including aramid fibers.

In some embodiments, each one of the flaps has a width of about 7.6 cm.

In some embodiments, the firefighter protective coat is compliant to NFPA 1971 (2013 edition) Standard on Protective Ensembles for Structural Fire Fighting and Proximity Fire Fighting.

In accordance with another aspect, there is provided a closure assembly for a closable front opening between left and right front panels of a firefighter protective coat, each of the left and right front panels a border area extending along said front opening and further including a closure flap foldable over the border area. The closure assembly includes a plurality of hook-and-dee pairs. Each hook-and-dee pair includes a hook and a dee. The hook is configured to be affixed to one of the left and right front panels within the corresponding border area, the hook including a hooking piece sized to extend across a width of the border area and an asymmetric base configured to be fastened to the corresponding coat panel, the asymmetric base including upper and lower wings projecting strictly on top and bottom sides of the hooking piece. The dee is configured to be affixed to an opposite one of the left and right front panels within the corresponding border area and in alignment with the corresponding hook of said pair.

In some embodiments, the dee includes a ring engageable with the hooking piece of the corresponding hook and a longitudinal base configured to be fastened to the corresponding coat panel and extending parallelly to the front opening.

Closure assembly for firefighter protective garments assembly is described herein.

In one embodiment, such a closure assembly may include positive closure element(s) and nonpositive closure element(s) provided on a firefighter coat having a front portion and a closure area. The firefighter protective coat preferably includes an outer shell and a front opening. The outer shell includes a top end and an opposite bottom end. The outer shell also includes a right coat side panel and a left coat side panel disposed in the front portion. The front opening is provided in the front portion and extends from the top end to the bottom end, separating the right coat side panel from the left coat side panel.

The positive closure assembly may include a plurality of pairs of engageable and releasable hook and dee, and may also include, in some embodiments, a zipper for closing the front opening 32.

In one embodiment, the hook may have a base including a first and a second wing regions. Two holes may be provided on the first wing region and one hole may be provided on the second wing region, resulting in an asymmetric configuration. Such configuration may prevent the hook from pivoting about one or more axis, and may limit a potential pivot of the hook.

The hook may be attached to the firefighter coat with capped rivets passing through the holes. The asymmetric configuration of the hook and the positioning of the holes may limit at least one degree of freedom of the hook, so as it may not tilt, rotate, roll or pitch about any one of its axes.

The hook may have a length equal to or smaller than 5.5 cm.

In yet another embodiment, the dee may be provided with two holes to permit the installation of the dee. The positioning of the holes may limit a potential pivot of the dee about one or more axis. More particularly, when the dee is attached to the firefighter coat, the configuration of the dee, as well as the positioning of the holes, limit one (or more) degree of freedom of the dee, so as it may not tilt, rotate or roll about the axis any one of its axes.

The dee may have a length equal to smaller than 3.9 cm.

In one embodiment, the nonpositive closure element(s) may include an internal flap and an external flap. The internal flap preferably has two opposed longitudinal edges. One of the two opposed longitudinal edges may be fixedly attached to the right portion, and another one of the two opposed longitudinal edges may be free and transversally foldable onto the closure assembly (or vice-versa, in the case of an inverted closure assembly). The external flap also has two opposed longitudinal edges. One of the two opposed longitudinal edges may be fixedly attached to the left portion, and another one of the two opposed longitudinal edges may be free and transversally foldable onto the internal flap.

In yet another embodiment, the internal and external flaps are also approximately 3" wide.

Other features and advantages of the present invention will be better understood upon a reading of embodiments thereof with reference to the appended drawings

DETAILED DESCRIPTION

Figure 1:
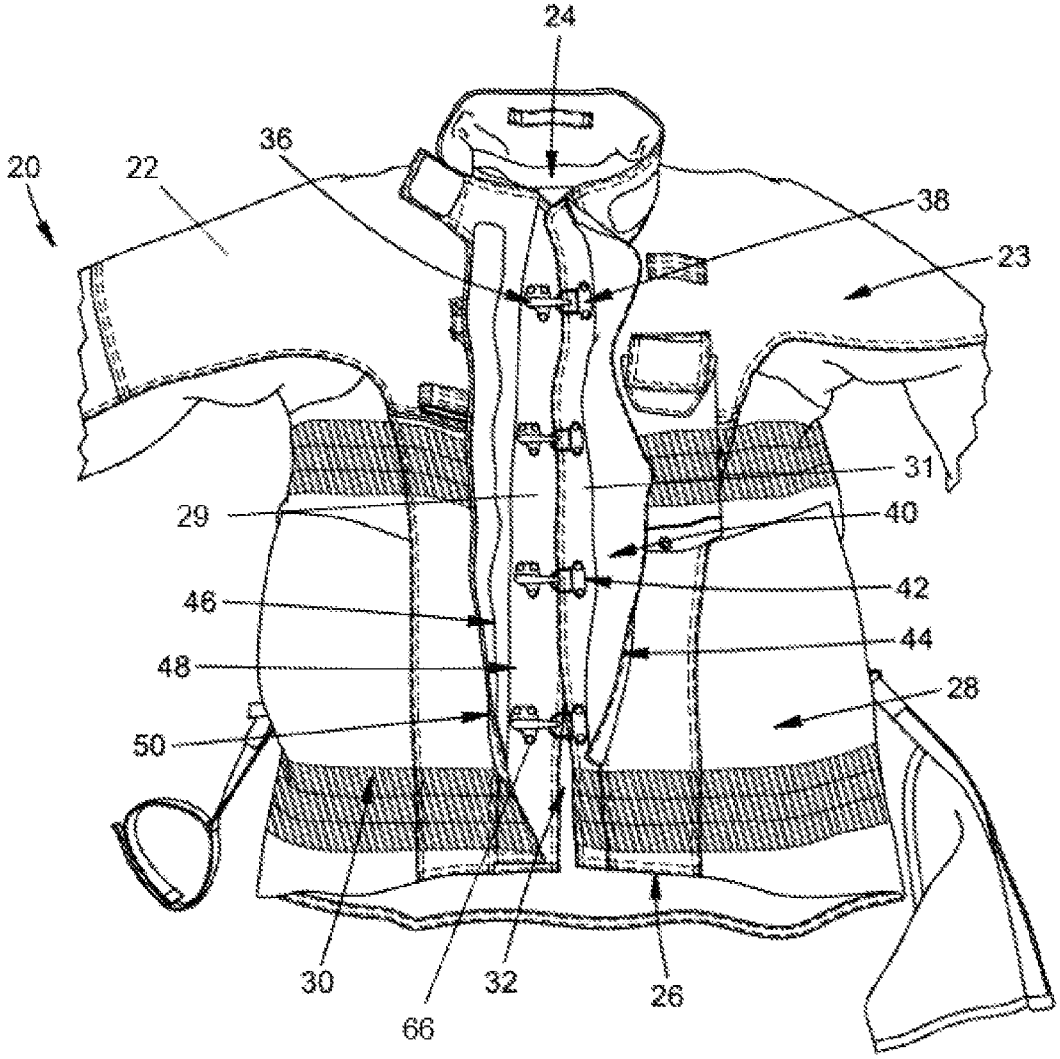
FIG. 1 shows a firefighter protective coat according to one embodiment.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale and that the emphasis is instead being placed upon clearly illustrating the elements and structures of the present embodiments.

The present description relates to closure system for firefighter garments, such as a firefighter protective coat, and more particularly to compact closure system for firefighter protective coat.

Generally described, the firefighter protective coat according to the embodiments presented in the current description typically includes an outer shell and a plurality of hook-and-dee pairs.

Referring to FIG. 1, there is shown an embodiment of a firefighter protective coat 20 including an outer shell 22.

The outer shell 22 has left and right front panels 28, 30. The left and right panels 28,30 define a closable front opening 32 therebetween. The closable front opening 32 can be closed with a closure assembly, such as the plurality of hook-and-dee pairs, as it will be described hereinbelow.

As illustrated, the closable front opening 32 is positioned near a middle section (sometimes referred to as a "central region") of a front portion 23 of the outer shell 22. The left and right front panels 28, 30 have a respective border area 29, 31, which extends along the front opening 32. The areas 29,31 define zones wherein the plurality of hook-and-dee pairs will be provided. In some embodiments, the border areas 29,31 each have a width equal to or smaller than about 7.6 cm.

In the depicted embodiment, and as it is usually the case, the front opening 32 of the firefighter protective coat 20 extends along a substantially vertical axis parallel to the longitudinal axis of the body of the firefighter. More particularly, the outer shell 22 includes a top end 24 and a bottom end 26 opposite the top end 24. When worn by a firefighter, the top end 24 is positioned near or at firefighter's neck height, while the bottom end 26 is positioned near or at waist height. As such, the front opening 32 extends from the top end to the opposite bottom end 26, from a region close to the neck to a region close to the waist of the firefighter, and thus separates the left coat side panel 28 from the right coat side panel 30.

In some embodiments, the outer shell 22 is made of a fire-retardant material, such as a fabric of aramid fibers (sold under the trademark NOMEX). As it will be readily understood, the outer shell 22 could be made from any number of layer(s), and could include different materials, as long as the firefighter coat 20 meets the requested requirements in terms of fire-retardant and/or flame-resistant properties.

The outer shell 22 also includes closure flaps 40,46. The closure flap provided on the left front panel 28 will be referred to as the left front panel flap or internal flap 40, while the closure flap provided on the right front panel 30 will be referred to as the right front panel flaps or external flap 46. The left and right front panel flaps 40,46 are foldable over the closure border areas 29, 31.

The closure flaps 40, 46 are typically embodied by a piece of fabric covering a respective one of the closure border areas 29, 31. In some implementations, the internal and/or external flap(s) 40,46 may each comprise multiple layers to make it resistant to liquid ingress or optimize other properties of interest. As known by one skilled in the art, the internal and external flaps 40, 46 may be made of a fire-resistant material such as a fabric of aramid fibers (sold under the trademark NOMEX), similarly to the outer shell 22. In one implementation, the internal and external flaps 40, 46 are made of a material optimising both the comfort and the protection of the wearer.

The internal flap 40 has two opposed longitudinal edges 42, 44. The longitudinal edge 42 is fixedly attached to the left coat side panel 28 of the firefighter coat 20. In one implementation, the longitudinal edge 42 may be seamed to the left coat side panel 28. The longitudinal edge 44 is free (i.e. not attached), and the internal flap 40 is hence transversally foldable (i.e. foldable along the transverse axis of the body of the firefighter) to cover the plurality of hook-and-dee pairs.

Similar to the internal flap 40, the external flap 46 has two opposed longitudinal edges 48,50. The longitudinal edge 48 is fixedly attached to the right coat side panel 30 of the firefighter coat 20. In one implementation, the longitudinal edge 48 may be seamed to the right coat side panel 30. The longitudinal edge 50 is free (i.e., not attached), and the external flap 46 is transversally foldable. When folded, the external flap covers the internal flap 40. More particularly, the internal and external flaps 40, 46 advantageously provide a barrier between the outer environment and the body of the firefighter in the closure area. Because the flaps 40,46 are positioned such that they longitudinally extend from the top portion 24 to the bottom portion 26 along the front opening 32, the flaps 40,46 completely close the front opening 32. As such, the flaps 40,46 leave no unprotected passage for potentially dangerous liquids or matter to penetrate under the firefighter coat 20 from the front opening 32, providing at the same time additional protection against heat.

Figure 8:
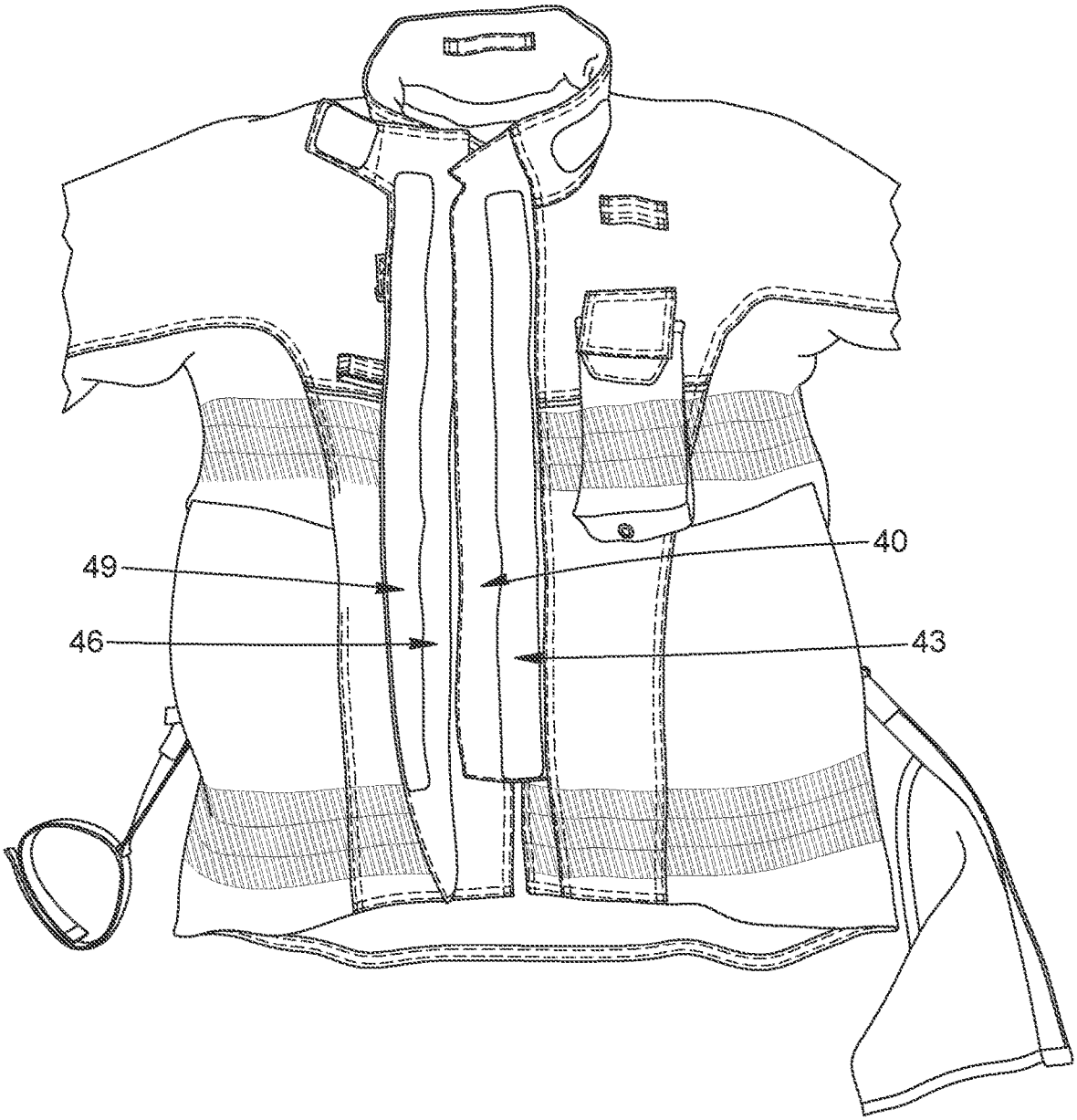
FIG. 8 is a partial front view of a firefighter protective coat, wherein an internal flap is folded onto a border area, according to one embodiment.
Figure 9:
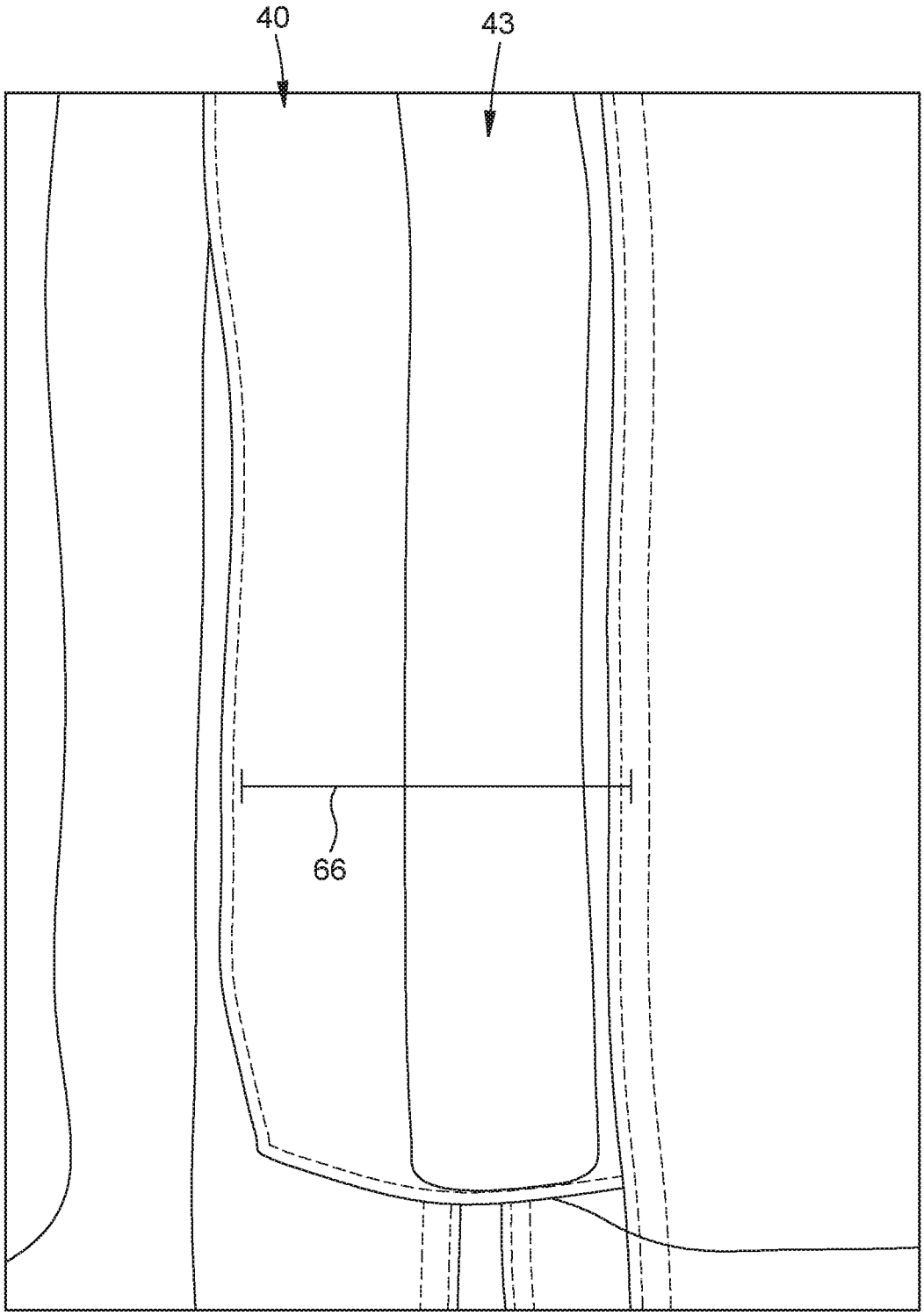
FIG. 9 is a partial front view of an internal flap, in accordance with one embodiment.

The flaps 40, 46 may be affixed to the outer shell 22 of the firefighter coat 20 through different mechanisms, such as seams, snap fastener arrangements, hook and loop fasteners 43, 49 (see FIGS. 8 and 9), combinations thereof, or the like. In the illustrated configuration of FIG. 1, one end of each one of the flaps 40,46 is affixed to a respective one of the left and right front panels 28,30 through a seam or seams extending along the edges 42 and 48 of the internal flap 40 and external flap 46, respectively (i.e., in a direction parallel to the longitudinal axis). In some embodiments, an attachment mechanism is provided near the edges 44, 48 of the internal and external flaps 40, 46, and more particularly near another one end of each one of the flaps 40,46. Generally described, the attachment mechanism could comprise, but is not limited to snap fastener arrangement, hook and loop fasteners 43, 49 (see FIGS. 8 and 9), a drawstring arrangement, combinations thereof, or other variants. Specifically, in the illustrated embodiment, the internal flap 40 has an outer surface including a strip of hook fasteners 43 as the attachment mechanism. In such embodiments, the external flap 46 has an inner surface including a strip of loop fasteners 49, engageable with the strip of hook fasteners 43. The strip of loop fasteners 49 is engaged with the strip of hook fasteners 43 when the external flap 46 is folded onto the internal flap 40. In other implementations, the internal flap has an outer surface including one of the pair of interlocking discs, and the external flap has an inner surface including another one of the pair of interlocking discs. In this implementation, the pair of interlocking discs are interlocked with one another when the external flap is folded onto the internal flap.

In some embodiments, the closure flaps 40, 46 each have a width of about 7.6 cm. The width of the closure flaps 40, 46 is typically approximately the same as the width of the closure border area.

The internal and external flaps are sometimes referred to as "nonpositive closure element(s)". In the context of the current description, the expression "nonpositive closure element(s)" may be understood as referring to nonpositive fasteners (i.e., different than the plurality of hook-and-dee pairs which will be described in the next section). Example of nonpositive fasteners are snaps or hook and pile tape. The nonpositive closure element(s) are typically used as supplementary garment closure devices, by contrast to positive and primary closure devices, which will now be described in further detail.

Now turning to FIGS. 1 to 4, the firefighter protective coat 20 includes a closure assembly 34, which includes a plurality of hook-and-dee pairs. Each hook-and-dee pair includes a hook 36 and a dee 38. It is to be noted that embodiments of the firefighter coat 20 herein described includes hook 36 and dee 38 that are structurally different than the conventional hook 35 and dee 33, as it will be described in further detail below. The expression "conventional hooks and dees" refers to hooks and dees already known by one skilled in the art.

The hooks 36 and dees 38 are sometimes referred to as "positive closing elements", by contrast to the nonpositive closing elements which have been described above. More generally, the expression "positive closure elements" may be understood as referring to positive locking fasteners, such as the hook 36 and the dee 38, or zippers. The positive closure element(s) are typically used to secure the closure assembly 34 in a manner that provides continuous moisture and thermal protection to the firefighter when the front opening 32 of the outer shell 22 is closed.

In the illustrated embodiment, the hook 36 is affixed to one of the left and right front panels 28,30 within the corresponding border area. In the illustrated embodiment, the hook 36 is affixed to the right front panel 30, and so the dee 38 is affixed to the left front panel 28. Generally, it will be understood that the hook 36 and dee 38 are affixed to opposite one of the left and right front panels 28,30 within the corresponding border area 29,31. The dee 38 is in alignment with the corresponding hook 36 of the hook-and-dee pair forming the closure assembly 34.

Figure 2A:
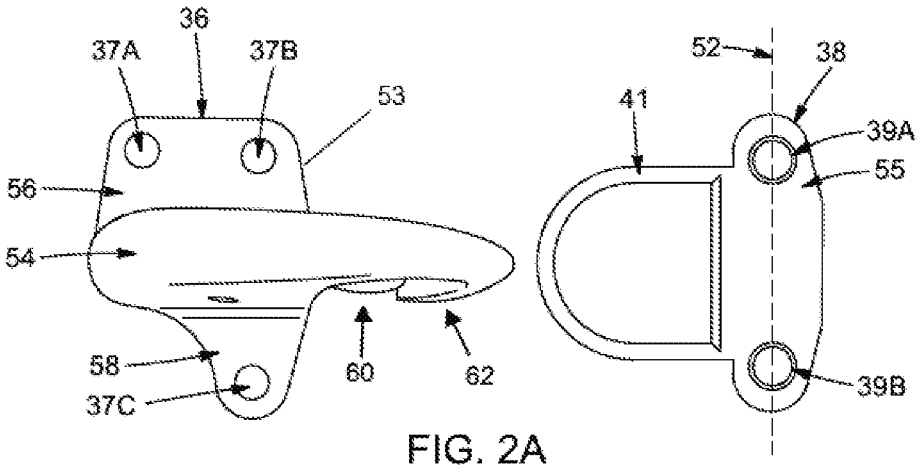
FIGS. 2A-B illustrate a hook-and-dee pair according to one embodiment, and a conventional hook-and-dee pair according to the prior art, respectively
Figure 3A:
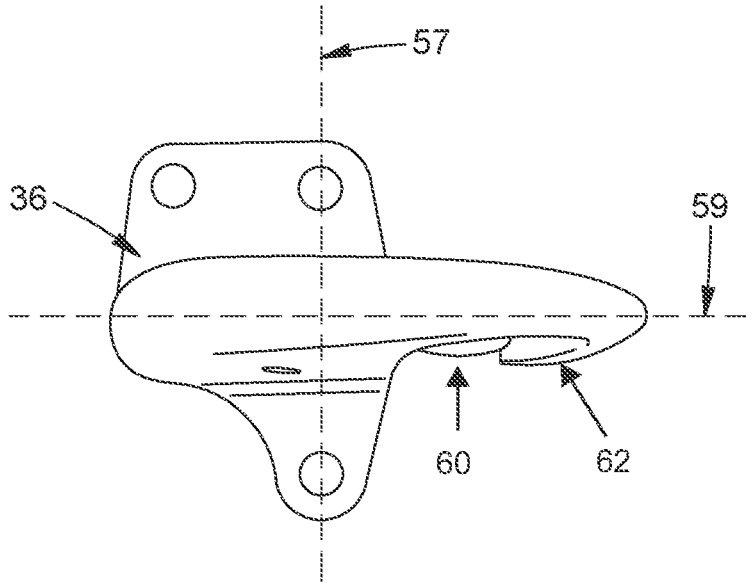
FIGS. 3A-B illustrate a hook according to one embodiment, and a conventional hook according to the prior art, respectively.

As better seen in FIGS. 2A and 3A, the hook 36 includes a hooking piece 54 and an asymmetric base 53. The hooking piece 54 extends across the width of the corresponding border area, e.g. the border area 31 of the right panel 30. In some embodiments, the hooking piece 54 has a length equal to or smaller than about 5.5 cm. In the context of the current disclosure, the "length" of the hooking piece 54 extends along an axis parallel to the traverse axis of the body of the firefighter. In some embodiments, the length of the hooking piece 54 is approximately the same as the width of the corresponding border area (e.g., the right border area 29) to which the hook 36 is affixed.

The hook 36 (also known as a "snap hook"), and more particularly the hooking piece 54 is made from a curved metal piece engageable with a portion of the dee 38. The hooking piece 54 includes a closing mechanism allowing the hook 36 to move from a closed configuration to an open configuration. More particularly, the curved metal piece comprises a movable part 60 and a stationary part 62 in contact at one of their respective end, and hence defining a ring-shaped space. When the movable part 60 is in contact with the stationary part 62, the hook 36 is said to be in the closed configuration. Upon an action of the firefighter (e.g., exerting a force onto the movable part 60), the closing mechanism allows the movable part 60 to move, so as to place the hook 36 is in the open configuration (i.e., the movable part 60 is no longer is contact with the stationary part 62). When the hook 36 is in the open configuration, the dee 38 may be inserted or slide within the ring-shaped space. The hook 36 may thereafter be closed by moving back the movable part 60 towards the stationary part 62 and putting the two parts back in contact. The hook 36 is thus in the closed configuration, and the hook and dee 36,38 are engaged.

When the hook 36 and the dee 38 are engaged, they are locked together (i.e., the dee 38 does not come off from the hook 36, without the action of the firefighter, in normal conditions of use). More particularly, the closing mechanism of the hook 36 is releasable, meaning that it has to be released (by the firefighter) to allow the portion of the dee 38 to disengage. As it will be readily understood, the hook(s) 36 and dee(s) 38 may be particularly useful for selectively closing or opening the firefighter coat's front opening 32.

As already known by one skilled in the art, the closing mechanism may, for example, be spring activated, meaning it may comprise at least one spring. For example, when the spring is released, the hook 36 is in the closed configuration. Inversely, the hook 36 is in the open configuration when the spring is contracted (i.e. compressed). Alternatively, the closing mechanism may be a ring clasp, a karabiner, or any type of shackle or metal loop. It will be understood that the movable part 60 of the hook 36 may act as a spring-loaded gate, so as to selectively engage/disengage the dee 38.

The asymmetric base 53 includes upper and lower wings 56,58. The upper and lower wings 56,58 project strictly on top and bottom sides of the hooking piece 54 when the hook 36 is affixed to the right front panel 30 of the outer shell 22. It is to be noted that the directional qualificatives "upper" and "lower" refers to the position of the upper and lower wings when the asymmetric base 53 is fastened to the corresponding coat panel, e.g., the right front panel 30.

Figure 2B:
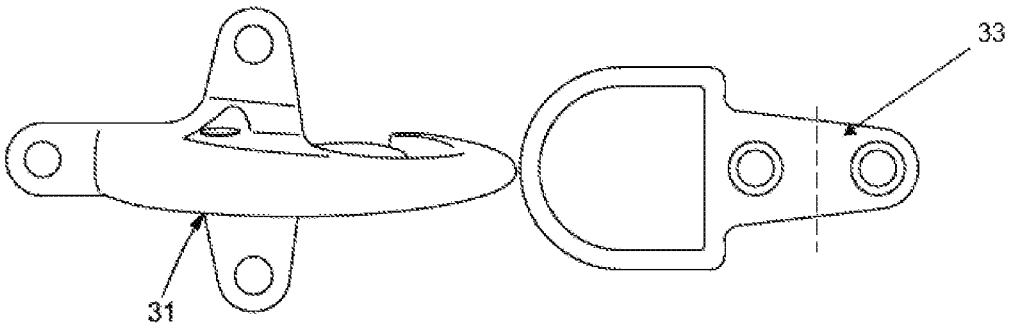
FIG. 2B (PRIOR ART)
Figure 3B:
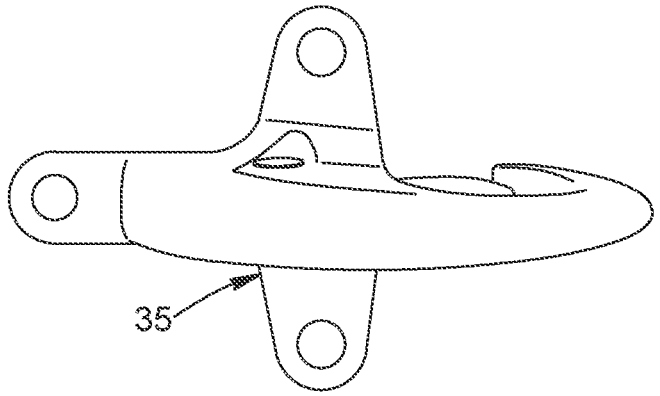
FIG. 3B (PRIOR ART)

In the context of the present disclosure, the term "strictly" refers to the fact that the upper and lower wings 56, 58 have an extend defining a footprint area which is fully confined within the corresponding closure border area (e.g., the border area 31 of the right panel 30), without projecting beyond the hooking piece 54 in a direction away from the front opening 32. By contrast, FIGS. 2B and 3B show a conventional hook 35, i.e., a hook according to prior art. As it can be seen in these figures, the conventional hook 35 has a base having an extend which project above, below, but also beyond a rearmost portion of the conventional hook 35 (i.e., not only above and below the conventional hook).

The firefighter protective coat 20 further comprises fasteners for affixing the hook 36 to the corresponding one of the left and right front panels, e.g., the right front panel 30. For this purpose, the asymmetric base 53 includes a plurality of hook attachment holes (simply referred to as "hook attachment holes"), denotated by the reference characters 37A-C in FIG. 2A. Each one of the hook attachment holes 37A-C is traversed by one corresponding fastener for affixing the hook 36 to one of the left and right front panels 28,30. For example, in the embodiment illustrated in FIG. 1, the asymmetric base 53 is affixed to the right front panel 30.

In some embodiments, the upper wing 56 of the asymmetric base 53 comprises two of the plurality of hook attachment holes, e.g., the holes 37A,B. The lower wing 58 comprises one of the plurality of hook attachment holes, e.g., the hole 37C. In some embodiments, the fasteners are capped rivets 66 (see FIG. 1) or other attachment means known by one skilled in the art, such as, for example and without being limitative, nuts and bolts.

As better seen in FIG. 3A, the hook 36 has a first axis 57 and second axis 59. When the hook 36 is mounted on the firefighter coat 20, the first axis 57 is substantially parallel to the longitudinal axis of the body of the firefighter, while the second axis 59 is substantially parallel to the transverse axis of the body of the firefighter. The positioning of the holes, as described above, is hence asymmetric with respect to the first and second axes 57,59. As illustrated, the two holes 37A,37B are provided on the first wing region 56, side-by-side along a direction parallel to the second axis 59, and the hole 37C is provided on the second wing region 58. The asymmetric configuration of the holes 37A-C prevents the hook 36 from pivoting about its first and second axes 57,59. Indeed, the positioning of the holes 37B,37C from either side of the hooking piece 54 blocks (or at least limits) a potential pivot of the hook 36 about the second axis 59 (also referred to as "rolling", i.e., tilting side to side about its second axis 59). Similarly, the hole 37A is positioned so as to prevent the hook 36 to pivot about the first axis 57 (also referred to as "pitching", i.e., tilting about its first axis 59). More particularly, when the hook 36 is attached to the firefighter coat 20 with capped rivets 66 (see FIG. 1) passing through the holes 37A-C, the asymmetric configuration of the hook 36, as well as the positioning of the attachment points 37A-C, limit (or alternatively block) at least one, and preferably two degree(s) of freedom of the hook 36, so as it does not tilt, rotate, roll or pitch about the two axes 57,59. The hook 36 is hence more stable, which may facilitate or help a firefighter closing the front opening 32. It will be readily understood that the number of holes, as well as their positioning, shape, size and other relevant geometrical features may vary, and are not limited to the examples listed above.

In some embodiments, the hook 36 is designed and sized to meet specific requirements. For example, the hook 36 may have a length equal to or smaller than 5.5 cm. In this context, the "length" is substantially parallel to the second axis 59. The previously presented configuration of the hook 36 and the base 53, as well as the positioning of the holes 37A-C allow reducing the total length of the hook 36, so as it is more compact. When installed, the compact hook 36 occupies a smaller surface compared to conventional hooks used in firefighter coats of prior art. Conventional hooks (i.e. different from the firefighter coat disclosed in the present description, see for example the bottom portion of FIG. 3) typically have a length of at least 6.5 cm.

Figure 4A:
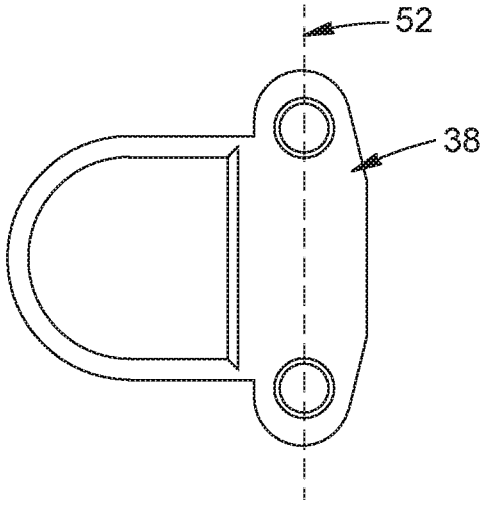
FIGS. 4A-B illustrate a dee according to one embodiment, and a conventional dee according to the prior art, respectively.
Figure 4B:
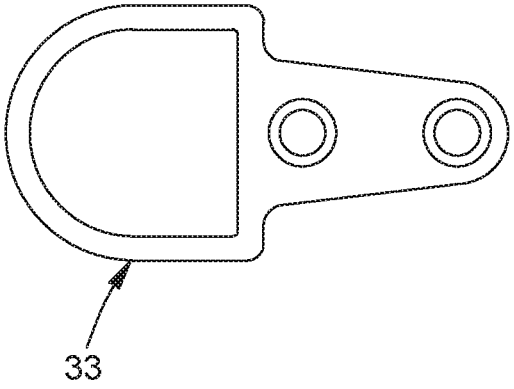
FIG. 4B (PRIOR ART)

Now turning to FIGS. 2A and 4A, the dee 38 includes a ring 41 engageable with the hooking piece 54 of the corresponding hook 36.

As its name entails, the dee 38 (also known as "D-Ring" or "dee-ring") includes a curved metal piece shaped like the capital letter "D". The curved metal piece has a rounded part 41 engageable with the hook 36.

The dee 38 includes a longitudinal base 55 fastened to the corresponding coat panel, e.g., the left front panel 28. The longitudinal base 55 extends parallelly to the front opening 32, i.e., the longitudinal base 55 has a longitudinal axis which extends along a substantially vertical direction.

In some embodiments, the dee 38 has a length equal to or smaller than about 3.9 cm. In the context of the current description, the length of the dee 38 refers to a dimension substantially parallel to the transverse axis of the body of the firefighter.

The firefighter protective coat 20 further comprises fasteners for affixing the dee 38 to the corresponding one of the left and right front panels, e.g., the left front panel 28. Similar to the hook 36, the longitudinal base 55 includes a plurality of dee attachment holes (simply referred to as "dee attachment holes"), denotated by the reference characters 39A-B in FIG. 2A. Each one of the plurality of dee attachment holes 39A-B is traversed by one corresponding fastener for affixing the dee to one of the left and right front panels. For example, in the embodiment illustrated in FIG. 2A, the longitudinal base 55 is affixed to the left front panel 30.

In some embodiments, the longitudinal base 55 can comprise two of the plurality of dee attachment holes 39A,B. The two dee attachment holes are extending parallelly to the front opening 32. In some embodiments, the fasteners are capped rivets, or any other attachment means known by one skilled in the art, such as nuts and bolts.

When the dee 38 is mounted on the firefighter coat 20, the axis 52 is substantially parallel to the longitudinal axis of the body of the firefighter. The configuration of the holes 39A,B prevents the dee 38 from pivoting about an axis perpendicular to the axis 52. Indeed, the positioning of the holes 39A,B blocks (or at least limits) a potential pivot of the dee 38 about the axis perpendicular to the axis 52 (also referred to as "rolling", i.e., tilting side to side about its second axis 57). More particularly, when the dee 38 is attached to firefighter coat 20 with capped rivets passing through the holes 39A,B, the configuration of the dee 38, as well as the positioning of the attachment points, limit (or alternatively block) one (or more) degree of freedom of the dee 38, so as it does not tilt, rotate or roll about the axis perpendicular to the axis 52. The dee 38 is hence more stable, which may facilitate or help a firefighter closing the front opening 32 by attaching the hook 36 to the dee 38. The configuration of the dee 38, as well as the positioning of the holes 39A-C allow reducing the length of the dee 38, so that it is more compact. When installed the compact dee 38 just described occupies a smaller surface than conventional dee. It will be readily understood that the number of holes, as well as their positioning, shape, size and other relevant geometrical features may vary, and are not limited to the examples listed above. In some embodiments, the dee 38 is designed and sized to meet specific requirements. For example, the dee 38 may have a length (extending substantially perpendicular to the longitudinal axis 52) smaller than 3.9 cm. As an example, the conventional dee used in firefighter coat of prior art (i.e., different from the firefighter coat disclosed in the present description) typically has a length of at least 4.9 cm.

The hook 36 and dee 38 presented in the current description provide a more compact closure assembly 34. When engaged, the hook 36 and dee 38 are substantially aligned along the first axis 57, and may reduce the overall length of the positive closure elements by approximately 2 cm (1 cm from the hook 36, and 1 cm from the dee).

It is also to be noted that, given the tasks performed by the firefighters, the hook 36 and dee 38 are made from rust-resistant metal. Examples of the most common used rust-resistant metals include, but are not limited to: zinc, nickel and treated stainless steel (e.g. galvanized steel). The hook 36 and dee 38 may also be made from a material that is not rust-resistant, but are in this scenario covered with a rust-resistant coating, such as zinc and nickel, which are two of the most common metals used for such coatings. The term "rust-resistant" herein refers to a property of some material(s) to limit or to be resistant to rust, or alternatively to a coating (e.g., a layer) providing protection from rust to a material that is not inherently rust-resistant. The term "rust" refers to the corrosion of iron and iron-based alloys. As it will be readily understood, the material forming the hook 36 and dee 38 may vary and are not limited to the list previously presented, but typically does not comprise iron-based materials, unless they have been processed accordingly. Furthermore, the material(s) forming the hook 36 and dee 38 are mechanically and thermally stable, so as to sustain the environment in which are performed the activities of firefighting.

The firefighter coat 20 described above has an open and a close configuration. As it has been previously mentioned, the internal and external flaps 40,46 may be folded or unfolded. In the open configuration, the hook 36 and dee 38 are not engaged (i.e. they are released from one another), and both the internal and external flaps 40,46 are unfolded. In the close configuration, the hook 36 is engaged (i.e., attached through its mechanism) with the corresponding dee 38. The internal and external flaps 40, 46 are folded on the hook and dee 36, 38. More particularly, in the closed configuration, the internal flap 40 is transversally folded onto the hook and dee 36, 38, and the external flap 46 is transversally folded onto the internal flap 40. Preferably, the attachment mechanisms of the internal and external flaps 40, 46 are respectively engaged (i.e., attached to one another).

Figure 5:
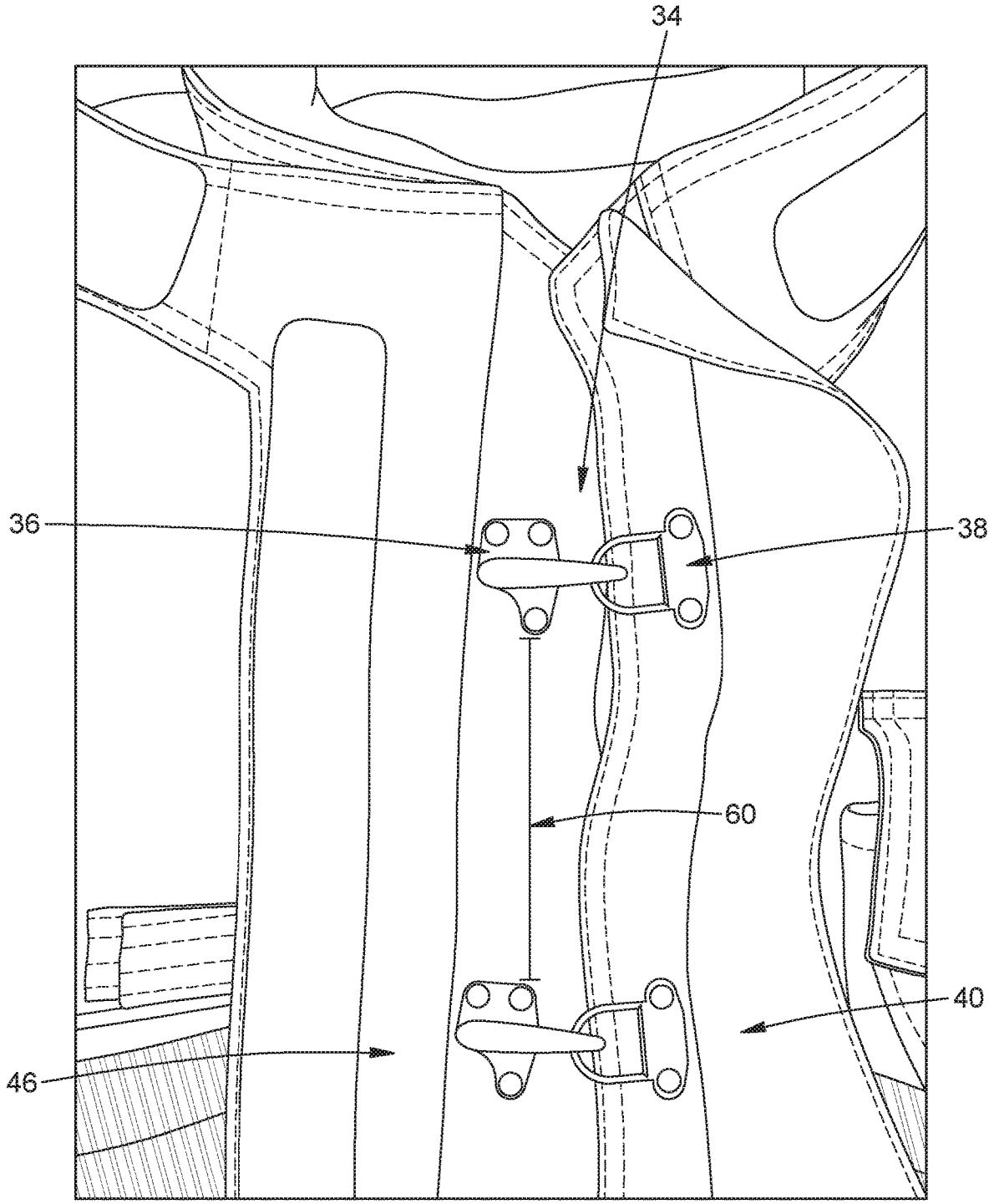
FIG. 5 shows a partial front view of a border area and two hook-and-dee pairs according to one embodiment.
Figure 6:
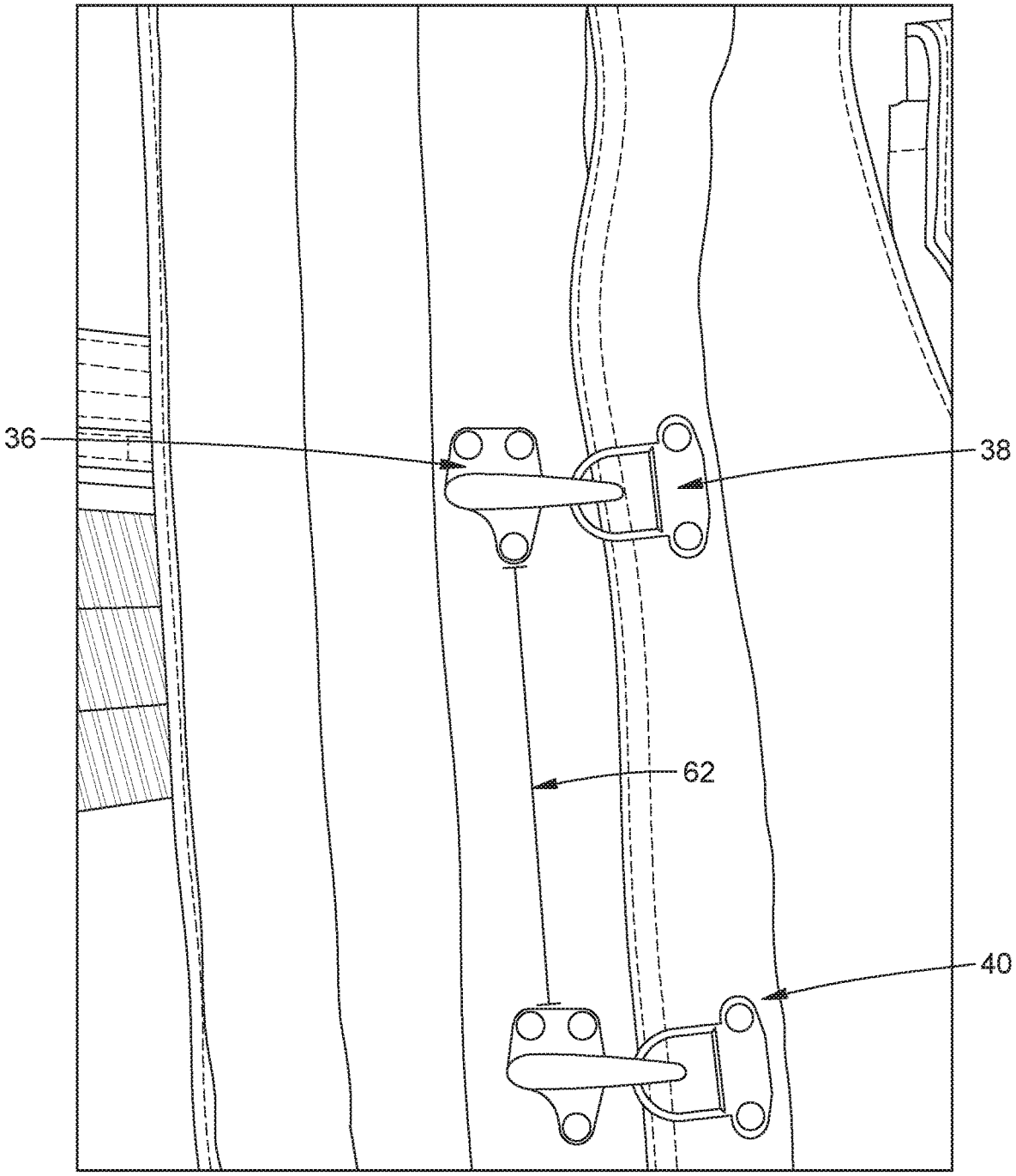
FIG. 6 shows another partial front view of a border area and two hook-and-dee pairs according to one embodiment.
Figure 7:
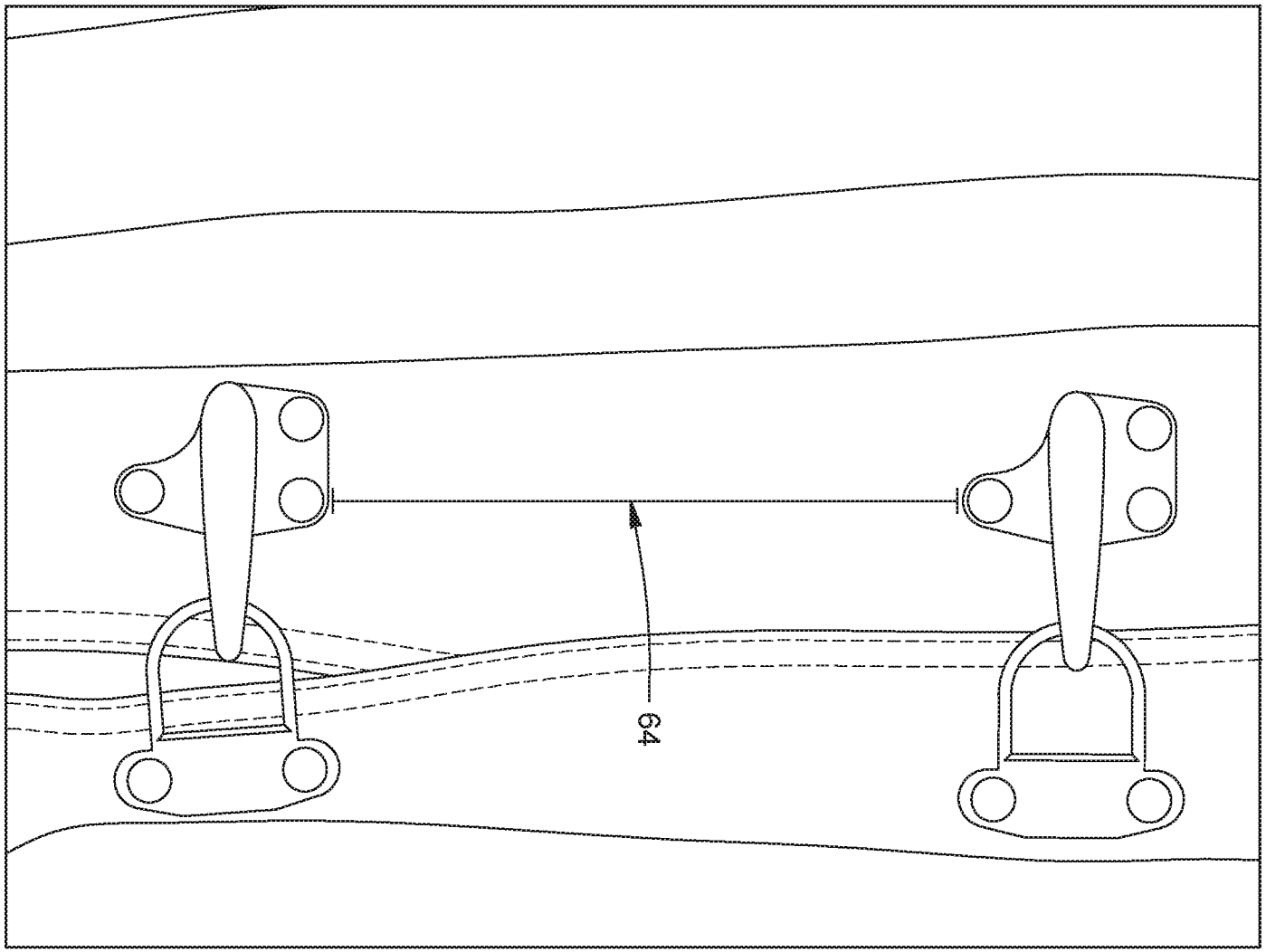
FIG. 7 shows another partial front view of a border area and two hook-and-dee pairs according to one embodiment.

Now referring to FIGS. 5 to 7, in one variant, a plurality of pairs of spaced-apart hook 36 and dee 38 are positioned along the front opening 32, and disposed along the longitudinal axis between the left and right front panels 28, 30. As illustrated, the hooks 36 are provided on the right coat side panel 30, while the dees 38 are provided on the left coat side panel 28. Of course, the hooks 36 could be provided on the left coat side panel 28 and the dees 38 on the right coat side panel 30. The left and right coat side panels 28,30 could even each comprise a combination of hook(s) 36 and dee(s), according to one's need. As it has been previously mentioned, the hooks 36 and dees 38 are held in position by means of capped rivets or similar fasteners. More particularly, in the illustrated variant, the firefighter protective coat 20 is provided with four pairs of spaced-apart hook 36 and dee 38. The vertical distance (parallel to the longitudinal axis) between each pair of hook 36 and dee 38 may be the same. For example, the distance may be approximately 5.5". In this scenario, the distance 60 between the first and second hook is about 5.5", the distance 62 between the second and third hook is about 5.5", and the distance 64 between the third and fourth hook is about 5.5". Similarly, the distance between the first and second dee is about 5.5", and so on. As it will be readily understood, the distance between the first and second hook (dee), second and third hook (dee), and third and fourth hook (dee), as well as the number of hooks 36 and dee 38 may of course vary according to one's need. For example, the firefighter coat 20 could include three or five pairs of hooks 36 and dee 38, according to the firefighter coat 20 size.

Because the length of both the hook 36 and dee 38 is reduced, the width of the flaps 40,46 covering the hook 36 and dee 38 may be reduced accordingly. For example, the external flap 46 may be about 3 inches wide, which is smaller (i.e., "more compact") than the typical external flap provided with the firefighter coat of prior art. The internal flap 40 may also be about 3 inches wide. Those dimensions may be useful, for example, for reducing the quantity of overlapping material needed in the closure area.

Figure 10:
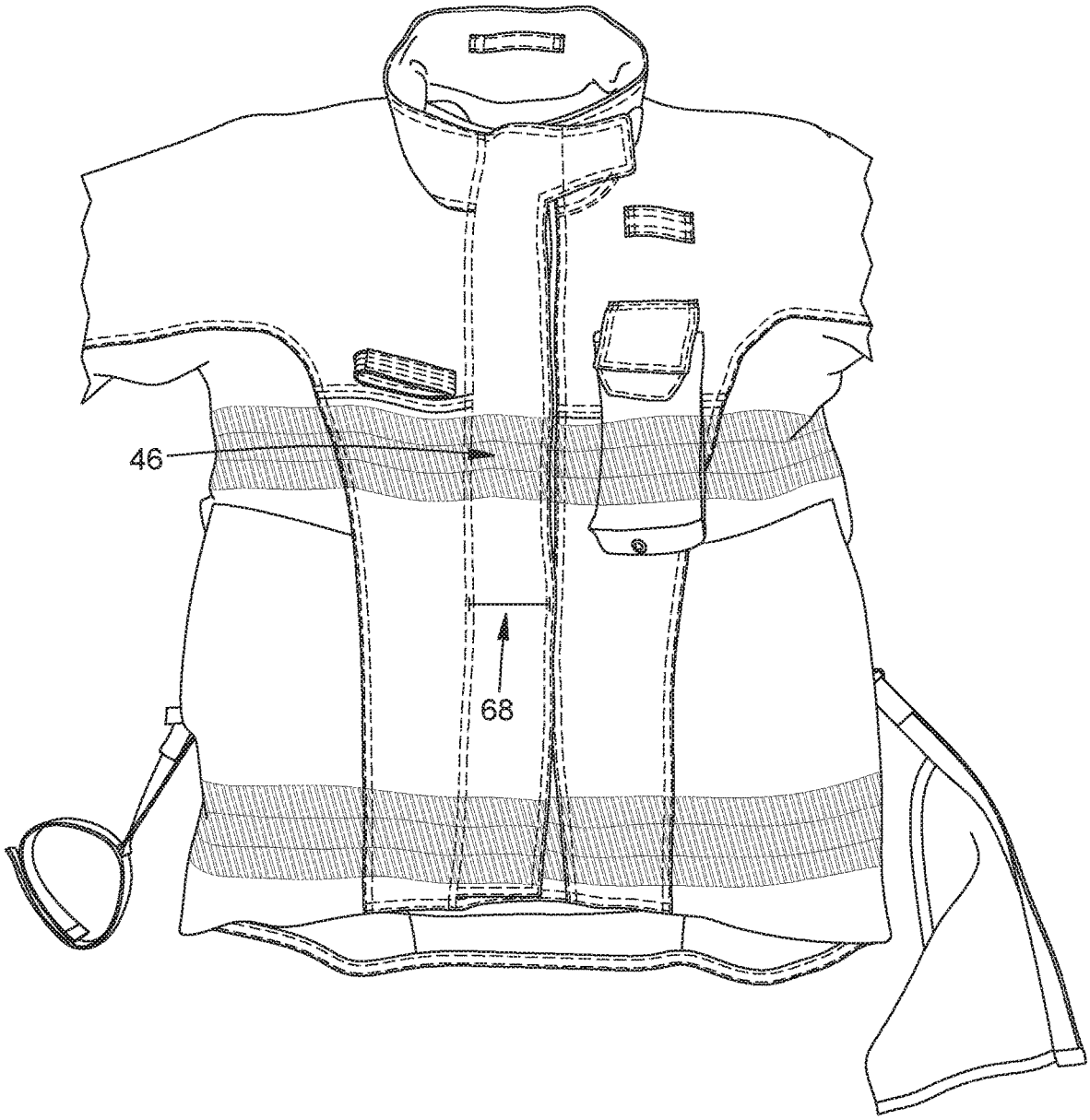
FIG. 10 is a partial front view of a firefighter protective coat, wherein an internal flap is folded onto a border area and an external flap is folded onto the internal flap, according to one embodiment.
Figure 11:
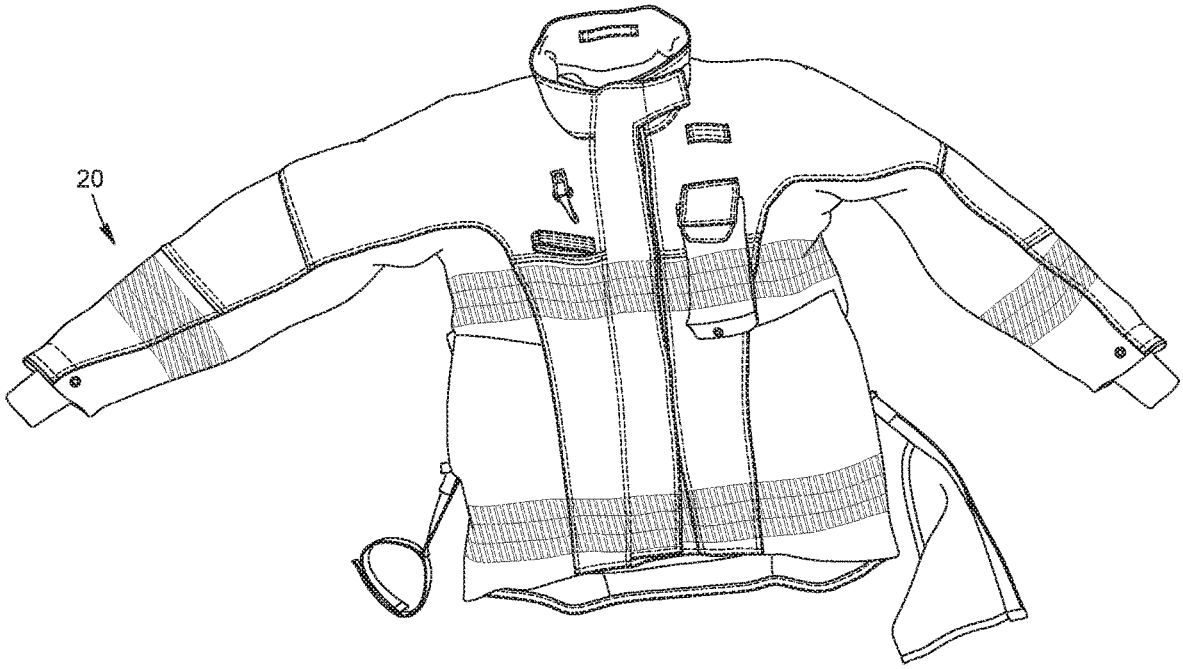
FIG. 11 is a front view of a firefighter protective coat according to one embodiment.
Figure 12:
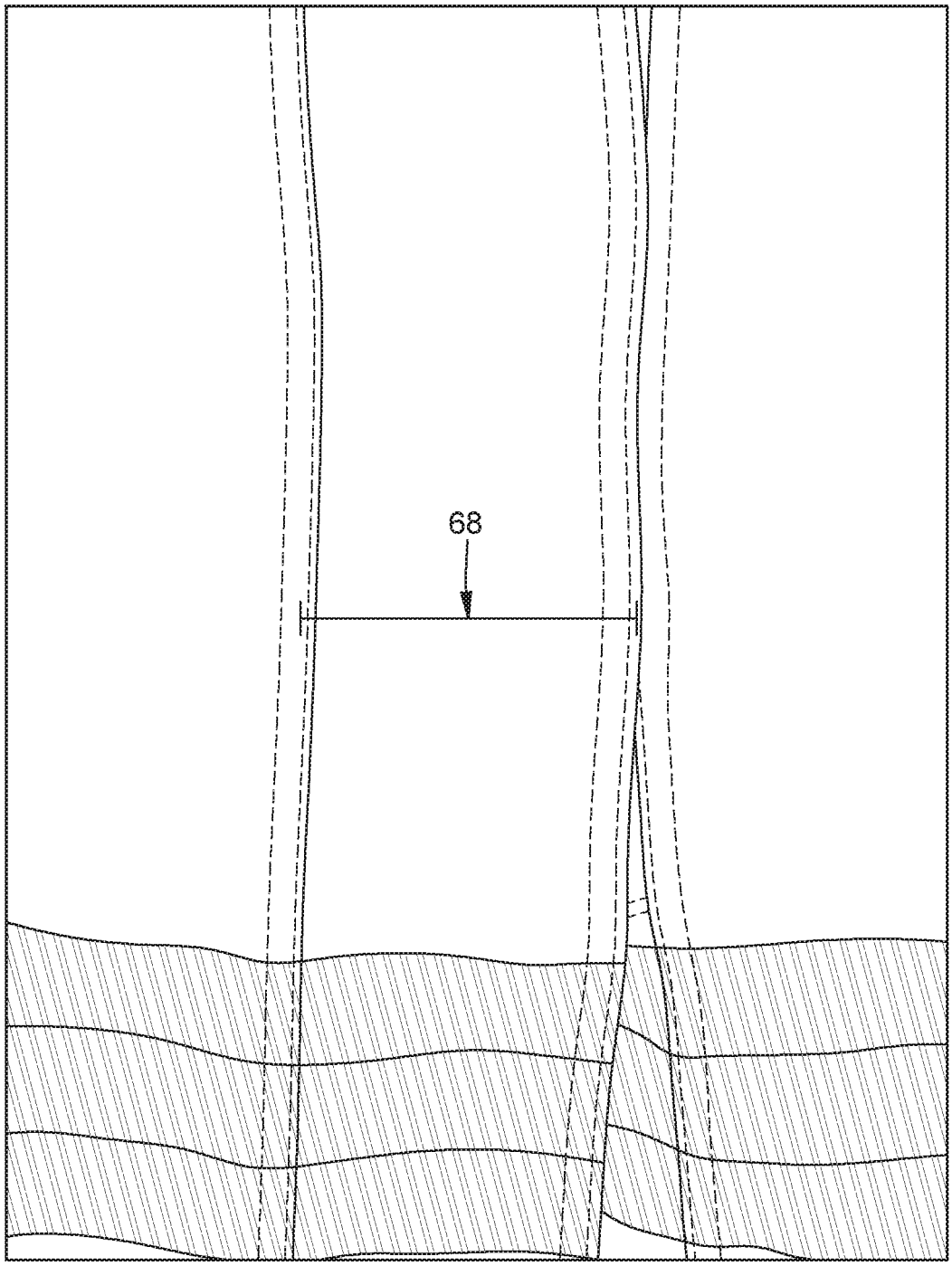
FIG. 12 is a partial front view of a firefighter protective coat, wherein an internal flap is folded onto a border area and an external flap is folded onto the internal flap, according to one embodiment.

In one variant illustrated in FIGS. 10 to 12, the closure assembly 34 is in the closed configuration (i.e. when the coat is in the closed configuration). The closure assembly is confined in a region having a width 68. The width 68 of the closure assembly 34 substantially corresponds to the distance between the two opposite lateral edges 48, 50 of the external flap 46 when the latter is folded. In some embodiments, the distance between the two opposite lateral edges 42,44 of the internal flap 40 and external flaps 46 may be the same. As shown, the width 68 is approximately 3" (or alternatively about 7.6 cm). The internal and external flaps 40,46 are also approximately 3" wide. Of course, it will be readily understood that this example is provided for illustrative purpose only and that other material and configuration may be used without departing from the scope of the invention.

As it has been previously mentioned, the hooks 36 and dees 38 presented in the current description provide a more compact closure assembly 34. Because the length (i.e., the dimension along the transverse axis) of both the hook 36 and dee 38 is reduced, the width of the flaps 40,46 covering the hook 36 and dee 38 may also be reduced accordingly. In the illustrated embodiments, the external flap 46 is equal or smaller than about 3 inches (or 7.6 cm), which is smaller (also referred to as being "more compact") than the typical external flap provided with the firefighter coat of prior art. Such a shorter length is achievable because the first and second wings project strictly on top and bottom of the hooking piece 56 of the hook and because the longitudinal base 55 of the dee 38 extends parallelly to the front opening 32, as it has been previously described.

One advantage associated of the compact closure assembly 34 is an increase in comfort and ease of movement resulting from the reduced quantity of material needed near the front opening 32 of the firefighter coat 20 for closing the latter. A greater surface area is hence available on the left and right front panels 28, 30, as a result of using flaps 40,46 of smaller width. The resulting free space may be used, for example, for adding pockets, straps, or any other elements desired and/or required by the firefighter, as it is illustrated in FIG. 12.

As it will be appreciated, in nearly all embodiments, the firefighter coat 20 is compliant with the National Fire Protection Association Standard on Protective Ensembles for Structural Fire Fighting and Proximity Fire Fighting. For example, in some embodiments, the firefighter protective coat 20 is compliant to NFPA 1971 (2013 edition and/or subsequent edition to be published, e.g., 2018 edition) Standard on Protective Ensembles for Structural Fire Fighting and Proximity Fire Fighting.

Of course, numerous modification could be made to the embodiments above without departing from the scope of the present invention.

The invention claimed is:

1. A firefighter protective coat comprising:

an outer shell having left and right front panels defining a closable front opening therebetween, each of the left and right front panels having a respective border area extending along said closable front opening and comprising a respective closure flap foldable over the respective border area; and a plurality of hook-and-dee pairs, each hook-and-dee pair comprising:

a hook affixed to one of the left and right front panels within the respective border area, the hook comprising:

a hooking piece extending across a width of the respective border area; and an asymmetric base having a first axis substantially parallel to a longitudinal axis of a firefighter's body when the firefighter protective coat is worn by the firefighter, the asymmetric base comprising:

upper and lower wings projecting strictly on top and bottom sides of the hooking piece, wherein one of the upper and lower wings is larger than another one of the upper and lower wings; and a plurality of hook attachment holes distributed across the upper and lower wings and positioned to prevent a pivot of the hook about the first axis, wherein at least two of the plurality of hook attachment holes are substantially aligned with the first axis and at least one of the plurality of hook attachment holes is laterally offset from the first axis, wherein a largest one of the upper and lower wings comprises at least one more hook attachment hole than a smallest one of the upper and lower wings; and a dee affixed to an opposite one of the left and right front panels within the corresponding border area and in alignment with the corresponding hook of said pair, the dee comprising a ring engageable with the hooking piece of the corresponding hook and a longitudinal base fastened to the corresponding coat panel and extending parallelly to the closable front opening and the first axis.

2. The firefighter protective coat of claim 1, further comprising fasteners, wherein:

each one of the plurality of hook attachment holes is traversed by one corresponding fastener for affixing the hook to said one of the left and right front panels; and the longitudinal base comprises a plurality of dee attachment holes, each one of the plurality of dee attachment holes being traversed by another one corresponding fastener for affixing the dee to said opposite one of the left and right front panels.

3. The firefighter protective coat of claim 1, wherein:

the upper wing is larger than the lower wing;

the upper wing comprises two of the plurality of hook attachment holes; and the lower wing comprises one of the plurality of hook attachment holes.

4. The firefighter protective coat of claim 2, wherein:

the longitudinal base comprises two of the plurality of dee attachment holes, said two of the plurality of dee attachment holes extending parallelly to the front opening.

5. The firefighter protective coat of claim 1, wherein each one of the hooks forming the plurality of hook-and-dee pairs is affixed to the right front panel and wherein each one of the dees forming the plurality of hook-and-dee pairs is affixed to the left front panel.

6. The firefighter protective coat of claim 1, wherein the upper and lower wings have an extent defining a footprint area, the footprint area being fully confined within said respective border area.

7. The firefighter protective coat of claim 1, wherein the hooking piece has a length equal to or smaller than about 5.5 cm.

8. The firefighter protective coat of claim 1, wherein the dee has a length equal to or smaller than about 3.9 cm.

9. The firefighter protective coat of claim 1, wherein the border area has a width equal to or smaller than about 7.6 cm.

10. The firefighter protective coat of claim 1, wherein:

the left closure flap is an internal flap having two opposed internal flap longitudinal edges, one of the two opposed internal flap longitudinal edges being fixedly attached to the left front panel and another one of the two opposed internal flap longitudinal edges being free and transversally foldable onto the plurality of hook-and-dee pairs; and the right closure flap is an external flap having two opposed external flap longitudinal edges, one of the two opposed external flap longitudinal edges being fixedly attached to the right front panel, and another one of the two opposed external flap longitudinal edges being free and transversally foldable onto the internal flap.

11. The firefighter protective coat of claim 10, wherein:

the internal flap has an outer surface comprising a strip of hook fasteners; and the external flap has an inner surface comprising a strip of loop fasteners, engageable with the strip of hook fasteners, the strip of loop fasteners being engaged with the strip of hook fasteners when the external flap is folded onto the internal flap.

12. The firefighter protective coat of claim 1, wherein each said respective closure flap is made of a fire-retardant material including aramid fibers.

13. The firefighter protective coat of claim 1, wherein each said respective closure flap has a width of about 7.6 cm.

14. The firefighter protective coat of claim 1, wherein the firefighter protective coat is compliant to NFPA 1971 (2013 edition) Standard on Protective Ensembles for Structural Fire Fighting and Proximity Fire Fighting.

15. The firefighter protective coat of claim 1, wherein the asymmetric base has a second axis substantially perpendicular to the first axis and wherein said at least one of the plurality of hook attachment holes being laterally offset from the first axis is substantially parallel or aligned with the second axis.

16. The firefighter protective coat of claim 1, further comprising hook fasteners, each of the hook fasteners passing through a corresponding one of the hook attachment holes for affixing the hook to said one of the left and right front panels.

17. The firefighter protective coat of claim 1, wherein the upper wing is larger than the upper wing.

18. A closure assembly for a closable front opening between left and right front panels of a firefighter protective coat, each of the left and right front panels having a respective border area extending along said closable front opening and comprising a respective closure flap foldable over the respective border area, the closure assembly comprising:

a plurality of hook-and-dee pairs, each hook-and-dee pair comprising:

a hook configured to be affixed to one of the left and right front panels within the respective border area, the hook comprising:

a hooking piece sized to extend across a width of the respective border area; and an asymmetric base having a first axis substantially parallel to a longitudinal axis of a firefighter's body when the firefighter protective is worn by the firefighter, the asymmetric base comprising:

upper and lower wings projecting strictly on top and bottom sides of the hooking piece, wherein one of the upper and lower wings is larger than another one of the upper and lower wings; and a plurality of hook attachment holes distributed across the upper and lower wings and positioned to prevent a pivot of the hook about the first axis, wherein at least two of the plurality of hook attachment holes are substantially aligned with the first axis and at least one of the plurality of hook attachment holes is laterally offset from the first axis, wherein a largest one of the upper and lower wings comprises at least one more hook attachment hole than a smallest one of the upper and lower wings; and a dee configured to be affixed to an opposite one of the left and right front panels within the corresponding border area and in alignment with the corresponding hook of said pair.

19. The closure assembly of claim 18, wherein the dee comprises a ring engageable with the hooking piece of the corresponding hook and a longitudinal base configured to be fastened to the corresponding coat panel and extending parallelly to the closable front opening and the first axis.

20. The closure assembly of claim 18, wherein the asymmetric base has a second axis substantially perpendicular to the first axis and wherein said at least one of the plurality of hook attachment holes being laterally offset from the first axis is substantially parallel or aligned with the second axis.

21. The closure assembly of claim 18, further comprising hook fasteners, each of the hook fasteners passing through a corresponding one of the hook attachment holes for affixing the hook to said one of the left and right front panels.

22. The closure assembly of claim 18, wherein the upper wing is larger than the lower wing.

* * * * *